US010082377B1

(12) United States Patent
Imhoff et al.

(10) Patent No.: US 10,082,377 B1
(45) Date of Patent: Sep. 25, 2018

(54) HINGEABLE OGIVE PROJECTILE

(71) Applicant: Sig Sauer, Inc., Newington, NH (US)

(72) Inventors: Jason Imhoff, Newington, NH (US); Ethan Lessard, East Kingston, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 15/446,609

(22) Filed: Mar. 1, 2017

Related U.S. Application Data

(60) Provisional application No. 62/301,868, filed on Mar. 1, 2016.

(51) Int. Cl.
*F42B 12/34* (2006.01)

(52) U.S. Cl.
CPC ..... *F42B 12/34* (2013.01)

(58) Field of Classification Search
CPC ..... F42B 12/24; F42B 12/34; F42B 12/28
USPC ..... 102/507–510, 512, 513, 517, 502, 506, 102/501
See application file for complete search history.

(56) References Cited

U.S. PATENT DOCUMENTS 594,199 A * 11/1897 Field ..... F42B 12/34 102/507
1,084,343 A * 1/1914 Johnson ..... F42B 12/34 102/507
4,776,279 A * 10/1988 Pejsa ..... F42B 12/34 102/510
6,178,890 B1 1/2001 Burczynski
6,305,292 B1 10/2001 Burczynski et al.
6,530,328 B2 3/2003 Burczynski et al.
6,805,057 B2 10/2004 Carr et al.
8,307,768 B2 * 11/2012 Cziglenyi ..... F42B 12/34 102/439
9,188,414 B2 11/2015 Burczynski
9,341,455 B2 5/2016 Fricke
9,534,876 B2 1/2017 Silvers
9,631,910 B2 * 4/2017 Fricke ..... F42B 12/34
2007/0079721 A1 * 4/2007 Webb ..... F42B 8/14 102/506

* cited by examiner

*Primary Examiner* — Reginald Tillman, Jr.
(74) *Attorney, Agent, or Firm* — Finch & Maloney PLLC

(57) ABSTRACT

Embodiments of the hingeable ogive projectile disclosed herein include a projectile comprising a nose portion comprising a plurality of slits, the plurality of slits being cut from an outer surface of the nose portion to a central cavity of the nose portion and an open space formed in a meplat at a distal end of the nose portion. The hingeable ogive projectile disclosed herein may be configured to switch from a non-deformed configuration during firing and a deformed configured upon impact with a target. Longitudinal compression of the nose portion causes the nose portion to expand radially and causes a plurality of petals to form from material in the nose portion between consecutive slits. Radial expansion and longitudinal compression of the nose portion cause buckling of a plurality of petals at a hinge point on each of the plurality of petals.

20 Claims, 5 Drawing Sheets

HINGEABLE OGIVE PROJECTILE

FIELD OF THE INVENTION

The present disclosure relates generally to ammunition. Specifically, the present disclosure is directed to a projectile that expands upon impact with a target.

BACKGROUND

Expanding projectiles may be used for increasing impact at a target point and may be useful for applications with reduced projectile speeds, for example with subsonic ammunition.

Subsonic ammunition is ammunition designed to operate at speeds less than the speed of sound, which at standard conditions is 343.2 m/s (1,126 ft/s). This avoids the supersonic shockwave or "crack" of a supersonic bullet, which particularly for suppressed or silenced firearms influences the loudness of the shot.

One way to accomplish effective bullet speeds below the speed of sound is to use a heavier bullet to reduce muzzle velocity below the speed of sound.

SUMMARY

The systems and methods described in the present disclosure provide an expanding projectile. The systems and methods described in the present disclosure provide a riveting projectile. The systems and methods described in the present disclosure refer to a projectile that has a rivet-like expansion effect following impact with a target. The systems and methods described in the present disclosure refer to a projectile that expands radially and is compressed longitudinally following impact with a target. The systems and methods described in the present disclosure relate to a hingeable ogive projectile. The ogive is the pointed, curved surface used to form the approximately streamlined nose of the projectile. A hinged ogive refers to a hinge point that is formed in the petals of the ogive following impact with a target. The terms hingeable ogive projectile, bullet, projectile, and expanding projectile may be used interchangeably herein to refer to the hingeable ogive projectile of the present disclosure.

Accordingly, pursuant to one aspect of the present disclosure, there is contemplated a projectile comprising a projectile body comprising a nose portion, located distally on the projectile, the nose portion comprising a plurality of slits, the plurality of slits being cut from an outer surface of the nose portion to a central cavity of the nose portion, a rear portion, located proximally on the projectile, and an open space formed in a meplat at a distal end of the nose portion around which the meplat forms a solid, unslit section.

The hingeable ogive projectile may be further characterized by one or any combination of the features described herein, such as the nose portion is formed of a monolithic section of material, the rear portion is a solid, unslit region comprising copper, a flat surface perpendicular to the direction of firing is formed on a distal end of the rear portion, a stepdown region is formed at the junction of the rear portion and the nose portion, a diameter to length ratio of the projectile is 1:5, the stepdown region is configured to stop compression of the projectile during impact with a target, the plurality of slits are positioned circumferentially about the nose portion, each of the plurality of slits is a longitudinal extension formed parallel to the direction of firing, impact with a target causes longitudinal compression of the nose portion of the projectile, longitudinal compression of the nose portion causes the nose portion to expand radially and causes a plurality of petals to form from material in the nose portion between consecutive slits, radial expansion and longitudinal compression of the nose portion cause buckling of the plurality of petals at a hinge point on each of the plurality of petals, a distal petal portion forms an angle of between 50 and 70 degrees with respect to the longitudinal axis following impact with a target, a proximal petal portion forms an angle of between 135 and 160 degrees with respect to the longitudinal axis following impact with a target, after impact the petals remain joined at the distal end.

Pursuant to another aspect of the present disclosure, there is contemplated a projectile, comprising a projectile body comprising a nose portion, located distally on the projectile, the nose portion comprising a plurality of slits, the plurality of slits being cut from an outer surface of the nose portion to a central cavity of the nose portion, a rear portion, located proximally on the projectile, and a closed distal end not including slits, wherein impact with a target causes longitudinal compression of the nose portion of the projectile, wherein longitudinal compression of the nose portion causes the nose portion to expand radially and causes a plurality of petals to form from material in the nose portion between consecutive slits, wherein radial expansion and longitudinal compression of the nose portion cause buckling of the plurality of petals at a hinge point on each of the plurality of petals.

The projectile may be further characterized by one or any combination of the features described herein, such as a distal petal portion forms an angle of between 60 and 80 degrees with respect to the longitudinal axis following impact with the target, a proximal petal portion forms an angle of between 135 and 160 degrees with respect to the longitudinal axis following impact with the target, after impact the petals remain joined at the distal end.

Further aspects, advantages and areas of applicability will become apparent from the description provided herein. It should be understood that the description and specific examples are intended for purposes of illustration only and are not intended to limit the scope of the present disclosure.

DESCRIPTION OF THE DRAWINGS

The drawings described herein are for illustration purposes only and are not intended to limit the scope of the present disclosure in any way.

DETAILED DESCRIPTION

Figure 1:
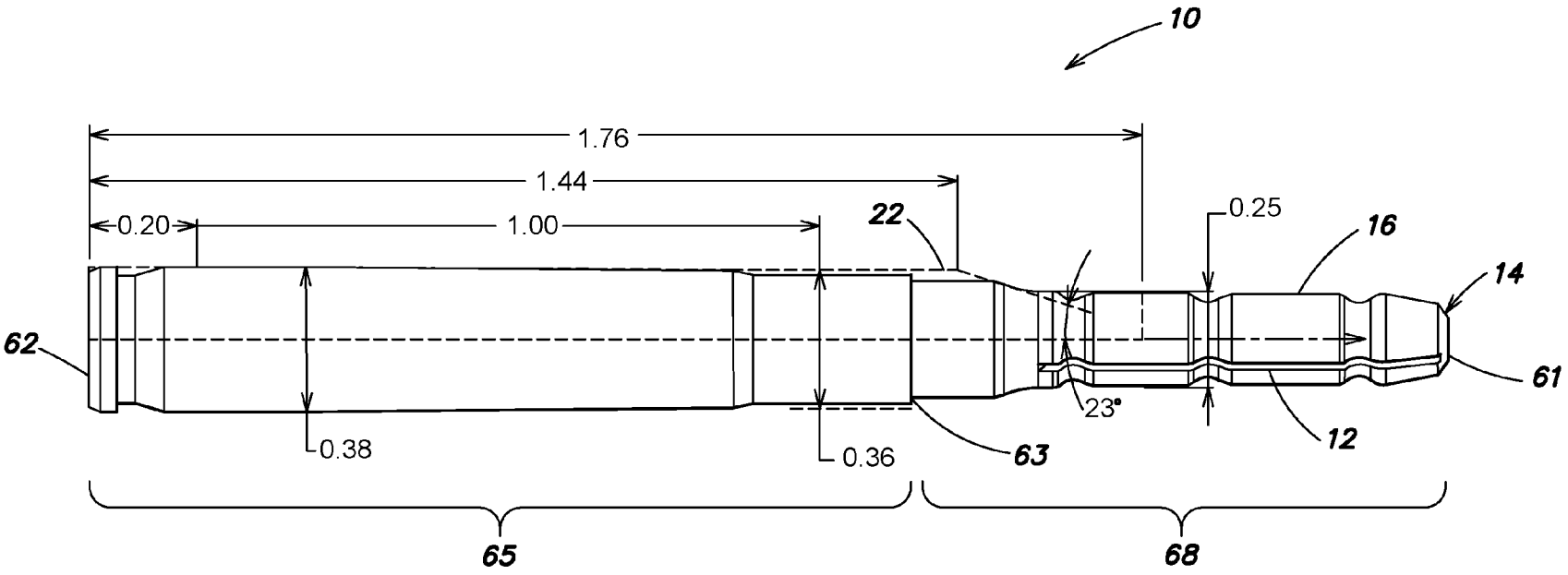
FIG. 1 shows a side view of one embodiment of a hingeable ogive projectile.

The following description is merely exemplary in nature and is not intended to limit the present disclosure, application, or uses. As will be seen, the devices and methods taught herein offer a hingeable ogive projectile. The hingeable ogive projectile may deform at a hinge point following impact with a target. The hingeable ogive projectile may be used as ammunition in a rifle or a handgun.

The hingeable ogive projectile described herein may have a distal nose portion and a proximal rear portion. The distal nose portion may be collapsible upon impact with a target. The distal nose portion may have a hollow core. The distal nose portion may be configured with slits through an outer wall of the nose portion. The distal nose portion may be configured with a plurality of slits through the nose portion. The slits may define longitudinal sections in the distal nose portion. The slits may extend from an outer wall to an inner hollow core. The slits may be parallel to the direction of firing, or may be configured to be skew to the direction of firing. The slits may extend from a point near but not at the distal end of the hingeable ogive projectile to a point distal to a joining point of the nose portion and the rear portion. The nose portion may be configured with a plurality of slits. There may be 3 or more, 4 or more, 5 or more, or 6 or more slits cut into the nose portion. The slits may be equally circumferentially spaced about the nose portion. The material in the nose cone located distal and/or proximal to the slits may be thicker than the material formed between the slits, in order to prevent tearing of the nose cone beyond the slits and prevent more expansion than desired.

A ratio of diameter to length may be 1:5, which would be more typical for rifle ammunition. Alternatively, a diameter to length ratio may be 1:2, which would be more typical for handgun ammunition. The diameter to length ratio of the projectile described herein may be designed for any diameter to length ratio between 1:2 and 1:10, or greater than 1:10, depending upon the desired application.

In one embodiment, the meplat, or flat of the nose at the distal end of the nose portion, may be a closed surface. The meplat is the central portion of the nose located at the distal end of the hingeable ogive projectile. The shape of the meplat may affect the ballistic coefficient and affect how the bullet moves through the air. In one embodiment, the meplat may form an open space centrally at the distal end of the nose portion. The open space in the meplat may have a diameter between 0.0001 and 0.30 mm. In one embodiment, the meplat may be pointed.

The hingeable ogive projectile described herein may be configured to switch from a non-deformed configuration during firing and a deformed configuration upon impact with a target. The hingeable ogive projectile described herein may provide improved expansion characteristics upon impact with a target.

During impact, material in the nose portion between the slits expands radially as the nose portion is compressed longitudinally. Material between the slits in the nose portion may expand to form a petal shape. Material between the slits in the nose portion may mushroom outward. The distal surface of the meplat on the nose portion may protrude following impact. At least one of the petals may deform upon impact with a target. At least one of the petals may buckle at a hinge point following impact with a target. The hinge point is designed to impose compression on the projectile following impact. At least one of the petals may deform such that a distal petal portion and a proximal petal portion form distinct angles with respect to the longitudinal axis of the bullet. The petals may deform such that the a distal petal portion 70 is at an angle $\alpha$ of between 40 and 90 degrees, between 50 and 85 degrees, or between 60 and 80 degrees, with respect to the longitudinal axis. The petals may deform such that a proximal petal portion 71 is at an angle $\beta$ of between 90 and 170 degrees, between 110 and 165 degrees, or between 135 and 160 degrees, with respect to the longitudinal axis.

In one embodiment, it is contemplated that the hingeable ogive projectile may be manufactured by forming a rear portion of a solid material, forming a nose portion of a monolithic section of material, forming an open space in the meplat at the distal end of the nose, forming an inner hollow core, and forming slits in the nose portion that cut from an outer surface to an inner hollow core. In some embodiments, the bullet is a solid copper bullet. Different materials may be used to manufacture the hingeable ogive projectile, including copper, copper alloys, brass, lead, lead alloys, or plastics.

Figure 2:
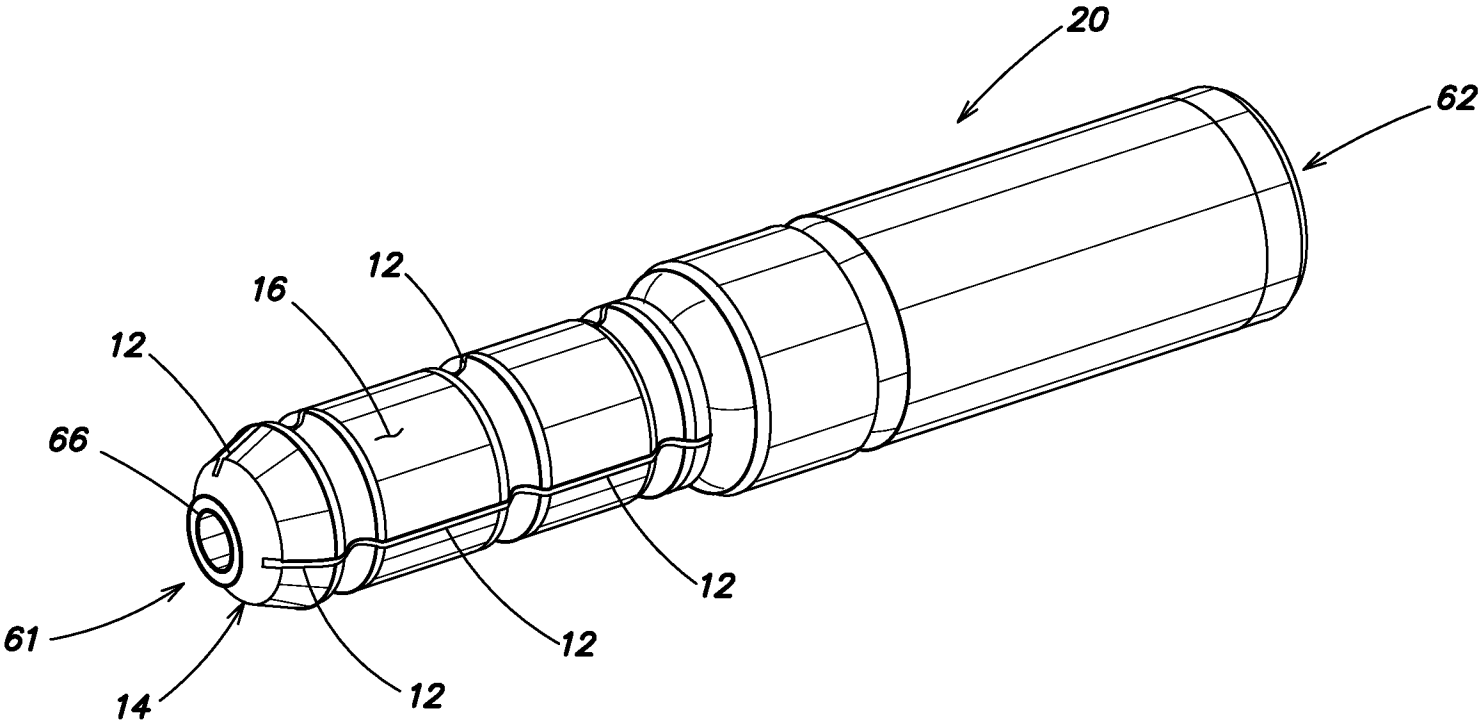
FIG. 2 shows a perspective view of one embodiment of the hingeable ogive projectile.
Figure 3:
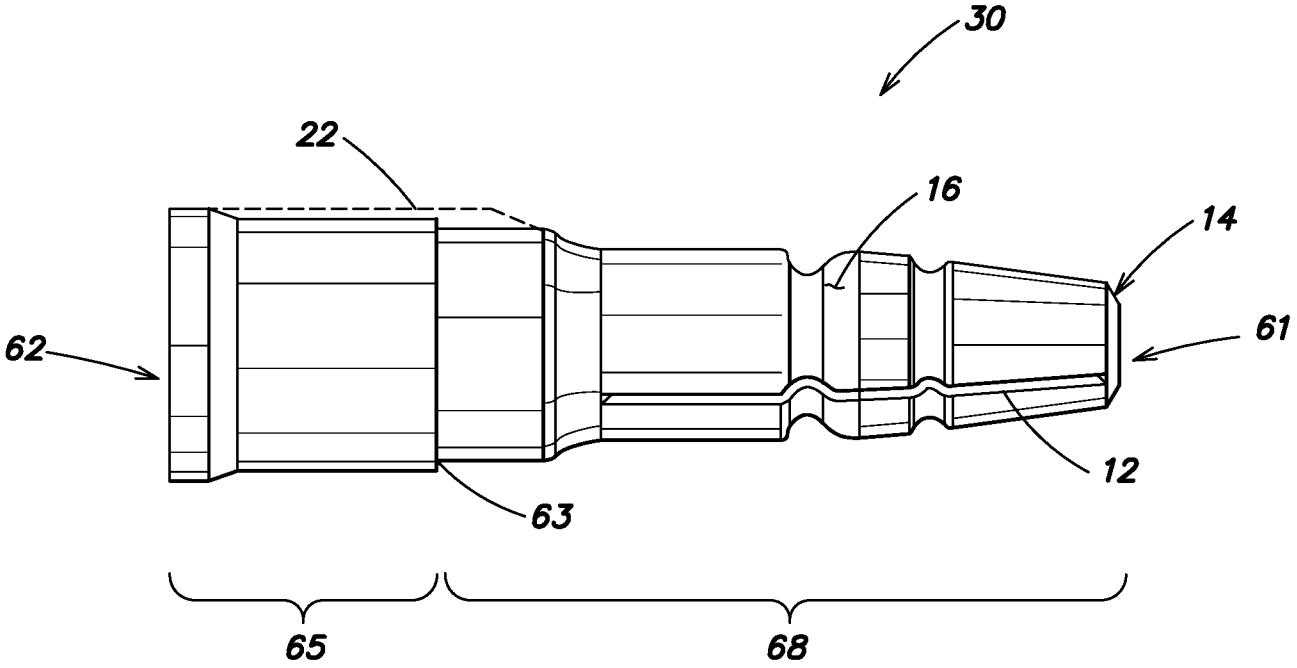
FIG. 3 shows a side view of one embodiment of the hingeable ogive projectile.
Figure 4:
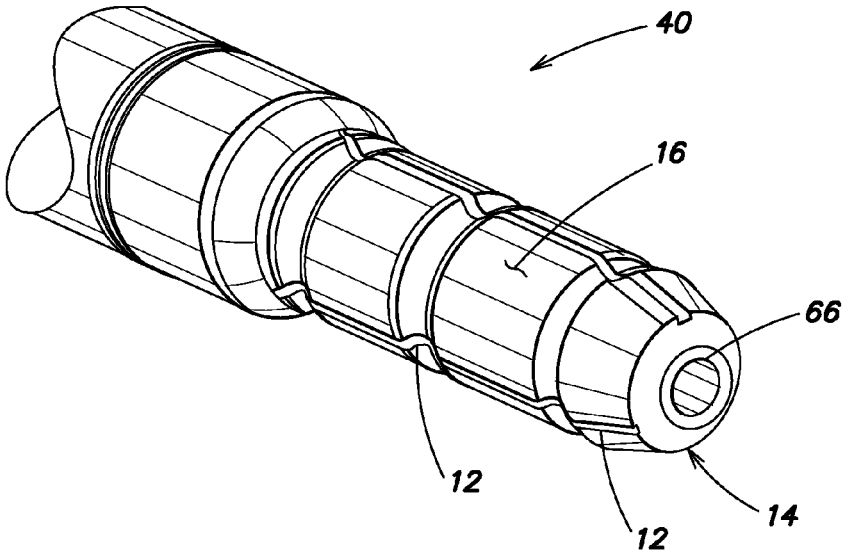
FIG. 4 shows a perspective view of one embodiment of the hingeable ogive projectile.
Figure 5:
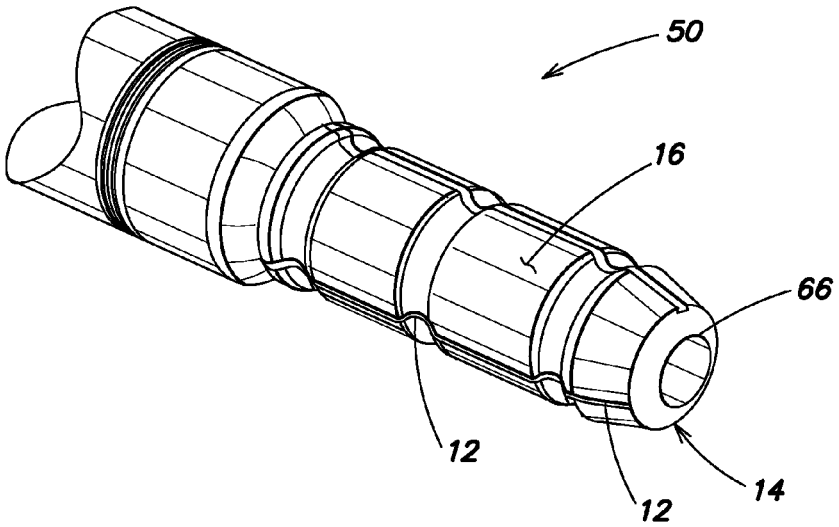
FIG. 5 shows a perspective view of one embodiment of the hingeable ogive projectile.

Turning now to the drawings to illustrate examples of embodiments of the present teachings, FIG. 1 details an example projectile 10 in a non-deformed configuration, in accordance with an embodiment. Nose portion 68 comprises slits 12, petals 16, distal end 61 at nose 14. Rear portion 65 comprises proximal end 62 and step down portion 63. FIG. 2 shows another example projectile 20 in a non-deformed configuration, in accordance with an embodiment. Projectile 20 includes meplat 66 at distal end 61 of nose 14, slits 12, petals 16, and proximal end 62. FIG. 3 shows a portion of another example bullet 30 in a non-deformed configuration, in accordance with an embodiment. Nose portion 68 comprises slits 12, petals 16, distal end 61 at nose 14. Rear portion 65 comprises proximal end 62 and step down portion 63. The bullet 10, 20, 30 has a geometry that allows the bullet to substantially maintain its shape through the high RPM ranges needed for improving dispersion. The bullet 10, 20, 30 is strong radially and tuned for buckling via slit features 12. For instance, the bullet includes several longitudinal slits 12 or grooves cut through the jacket to the center bore. The slits 12 do not cut through the nose 14. FIGS. 4 and 5 show portions of other example projectiles 40 and 50, in accordance with several embodiments of the present disclosure.

Figure 6:
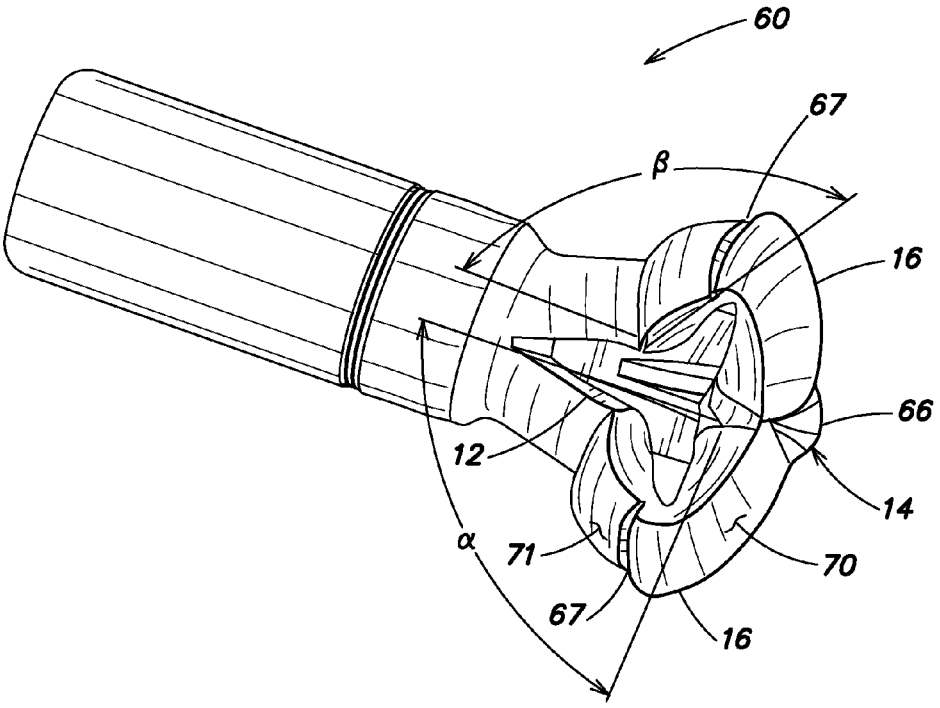
FIG. 6 shows a side view of one embodiment of the hingeable ogive projectile.
Figure 7:
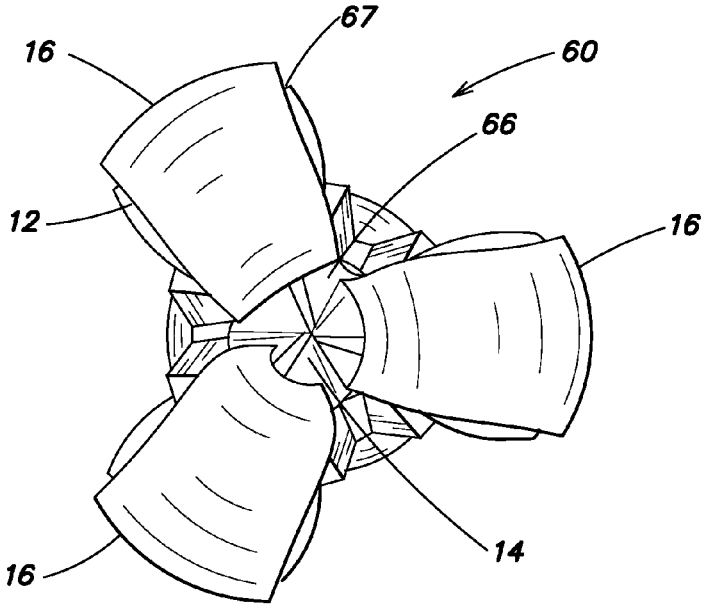
FIG. 7 shows a front view of one embodiment of the hingeable ogive projectile.

FIG. 6 is a side view of another example bullet 60 in a deformed configuration, and FIG. 7 is a front view of the example bullet 60 in the deformed configuration, in accordance with an embodiment. As seen in FIGS. 6 and 7, the slits 12 allow a portion of the bullet 60 to deform into several petals 16 or deformable members when the bullet 60 is spun at a high rate. The distal end of nose 14 forms a hinge that keeps the petals 16 intact as the bullet 60 deforms. For instance, the petals 16 may buckle, as shown in FIGS. 6 and 7, rather than bend and peel back from the nose. The deformation increases the area of the projectile, and acts like a parachute in the target to slow the bullet. The deformation of the petals serves to maximize energy transfer to the target.

In accordance with one embodiment, the bullet design improves feeding (e.g., 30 rounds in magazine) by mimicking the feeding geometry of a 5.56×45 bullet (shown by profile line 22 in FIGS. 1 and 3), thus allowing use of the bullet 10 in a magazine designed for a 5.56 profile. In other embodiments, the bullet design may be configured for different caliber bullets as well as for different magazines and/or weapon systems.

FIGS. 1 and 3 illustrate a flat surface 63 perpendicular to the direction of firing formed on the distal end of the rear portion. Flat surface 63 provides a stop for further collapse of the bullet resulting from impact. Flat surface 63 of solid rear portion 65 provides a rigid flat or step down region that prevents further collapse of the hingeable ogive projectile following impact.

The bullet described herein is configured to allow for a fast twist, which is useful for long and/or heavy bullets. The bullet described herein is configured to provide improved accuracy, flight through the air, and dispersion. The bullet described herein is configured to allow for an increased twist, which increases rotational kinetic energy to perform more consistently through a wide range of intermediate barriers. The bullet described herein is configured to allow for improved barrier performance.

In some embodiments, the bullet has a shoulder for proper feeding in a standard M4 magazine. In other embodiments, the bullet may be configured to be compatible with other magazines and/or other weapon systems.

Barrier blind projectiles are intended to penetrate approximately 18 inches into gelatin and come to a complete stop. This allows all or nearly all of the kinetic energy in the bullet to be transferred from the bullet into the target. Higher RPM provides better stability for these long projectiles, but also carries more rotational kinetic energy. Subsonic bullets are typically limited to approximately 1000 feet per second to remain quiet, so generally the projectile's mass is increased to increase energy on target (e.g. lethality). Based on the length of the cartridge and bore diameter, there is a practical maximum for liner kinetic energy. By increasing barrel twist rate, the total kinetic energy (linear plus rotational) can be significantly increased. For example, in some embodiments, the energy to target may be increased by over 700%. In some embodiments, the twist rate is approximately 1:1. For example, a projectile/barrel combination according to an embodiment (e.g. 6.75" 300BLK) may obtain a total kinetic energy of approximately 12700 foot-pounds.

The foregoing description of the embodiments of the disclosure has been presented for the purpose of illustration; it is not intended to be exhaustive or to limit the claims to the precise forms disclosed. Persons skilled in the relevant art can appreciate that many modifications and variations are possible in light of the above disclosure. Dimensions are provided for the purposes of describing specific embodiments The language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

The invention claimed is:

1. A projectile comprising:

a projectile body comprising:

a nose portion, located distally on the projectile, the nose portion comprising a plurality of slits, the plurality of slits being cut from an outer surface of the nose portion to a central cavity of the nose portion;

a rear portion, located proximally on the projectile; and an open space formed in a meplat at a distal end of the nose portion around which the meplat forms a tapered ring, the tapered ring being tapered inwardly from a proximal portion to a distal portion.

2. The projectile of claim 1, wherein the nose portion is formed of a monolithic section of material.

3. The projectile of claim 1, wherein the rear portion is a solid, unslit region comprising copper.

4. The projectile of claim 1, wherein a flat surface perpendicular to the direction of firing is formed on a distal end of the rear portion.

5. The projectile of claim 1, wherein a stepdown region is formed at the junction of the rear portion and the nose portion.

6. The projectile of claim 1, wherein a diameter to length ratio of the projectile is 1:5.

7. The projectile of claim 5, wherein the stepdown region is configured to stop compression of the projectile during impact with a target.

8. The projectile of claim 1, wherein the plurality of slits are positioned circumferentially about the nose portion.

9. The projectile of claim 6, wherein each of the plurality of slits is a longitudinal extension formed parallel to the direction of firing.

10. The projectile of claim 1, wherein impact with a target causes longitudinal compression of the nose portion of the projectile.

11. The projectile of claim 10, wherein longitudinal compression of the nose portion causes the nose portion to expand radially and causes a plurality of petals to form from material in the nose portion between consecutive slits.

12. The projectile of claim 11, wherein radial expansion and longitudinal compression of the nose portion cause buckling of the plurality of petals at a hinge point on each of the plurality of petals.

13. The projectile of claim 1, wherein a distal petal portion forms an angle of between 50 and 70 degrees with respect to the longitudinal axis following impact with a target.

14. The projectile of claim 1, wherein a proximal petal portion forms an angle of between 135 and 160 degrees with respect to the longitudinal axis following impact with a target.

15. The projectile of claim 12, wherein after impact the petals remain joined at the distal end.

16. A projectile comprising:

a projectile body comprising:

a nose portion, located distally on the projectile, the nose portion comprising a plurality of slits, the plurality of slits being cut along their length from an outer surface of the nose portion to an inner hollow core of the nose portion;

a rear portion, located proximally on the projectile; and a closed distal end not including slits, wherein impact with a target causes longitudinal compression of the nose portion of the projectile, wherein longitudinal compression of the nose portion causes the nose portion to expand radially and causes a plurality of petals to form from material in the nose portion between consecutive slits, wherein radial expansion and longitudinal compression of the nose portion cause buckling of the plurality of petals at a hinge point on each of the plurality of petals.

17. The projectile of claim 16, wherein a distal petal portion forms an angle of between 60 and 80 degrees with respect to the longitudinal axis following impact with the target.

18. The projectile of claim 16, wherein a proximal petal portion forms an angle of between 135 and 160 degrees with respect to the longitudinal axis following impact with the target.

19. The projectile of claim 16, wherein after impact the petals remain joined at the distal end.

20. A projectile comprising:

a projectile body comprising:

a nose portion, located distally on the projectile, the nose portion comprising a plurality of slits, the plurality of slits being cut from an outer surface of the nose portion to a central cavity of the nose portion;

a rear portion, located proximally on the projectile; and an open space formed in a meplat at a distal end of the nose portion around which a solid, unslit section is formed extending about a circumference at the distal end of the nose, wherein a stepdown region is formed at the junction of the rear portion and the nose portion and is configured to provide a reduced outside diameter of the projectile between the rear portion and the nose portion.

* * * * *